US009842553B2

(12) United States Patent
Lee et al.

(10) Patent No.: US 9,842,553 B2
(45) Date of Patent: Dec. 12, 2017

(54) METHOD OF DRIVING DISPLAY PANEL AND DISPLAY APPARATUS FOR PERFORMING THE SAME

(71) Applicant: SAMSUNG DISPLAY CO., LTD., Yongin, Gyeonggi-Do (KR)

(72) Inventors: Gi-Chang Lee, Asan-si (KR); In-Soo Wang, Asan-si (KR)

(73) Assignee: Samsung Display Co., Ltd., Yongin-si (KR)

( * ) Notice: Subject to any disclaimer, the term of this patent is extended or adjusted under 35 U.S.C. 154(b) by 79 days.

(21) Appl. No.: 14/618,874

(22) Filed: Feb. 10, 2015

(65) Prior Publication Data

US 2016/0012788 A1 Jan. 14, 2016

(30) Foreign Application Priority Data

Jul. 11, 2014 (KR) ..... 10-2014-0087339

(51) Int. Cl.
*G09G 3/36* (2006.01)

(52) U.S. Cl.
CPC ..... *G09G 3/3614* (2013.01); *G09G 2310/06* (2013.01); *G09G 2320/0204* (2013.01); *G09G 2320/0247* (2013.01); *G09G 2320/0257* (2013.01)

(58) Field of Classification Search
None
See application file for complete search history.

(56) References Cited

U.S. PATENT DOCUMENTS

2009/0251451 A1* 10/2009 Cha ..... G09G 3/3614 345/211
2009/0289928 A1* 11/2009 Shi ..... G09G 3/3614 345/209
2015/0269886 A1* 9/2015 Tan ..... G09G 3/3208 345/698
2015/0332651 A1* 11/2015 Miyazawa ..... G09G 3/3614 345/211
2016/0012789 A1* 1/2016 Miyazawa ..... G09G 3/3614 345/209
2016/0196789 A1* 7/2016 Suyama ..... G09G 3/3614 345/209

FOREIGN PATENT DOCUMENTS

KR 10-0242443 B1 2/2000
KR 10-2010-0056318 A 5/2010
KR 10-2011-0130707 A 12/2011
KR 10-2013-0028596 A 3/2013

* cited by examiner

*Primary Examiner* — Joseph Haley
*Assistant Examiner* — Emily Frank
(74) *Attorney, Agent, or Firm* — Lewis Roca Rothgerber Christie LLP

(57) ABSTRACT

A method of driving a display panel includes: generating a data signal having a difference between a number of positive frames and a number of negative frames; and displaying an image according to the data signal.

8 Claims, 8 Drawing Sheets

FIG. 8

N frame

| | | | | | |
|---|---|---|---|---|---|
| + | + | + | + | + | + |
| − | + | − | + | − | + |
| + | + | + | + | + | + |
| − | + | − | + | − | + |
| + | + | + | + | + | + |
| − | + | − | + | − | + |

P5 P6 P7 P8

N+1 frame

| | | | | | |
|---|---|---|---|---|---|
| + | + | + | + | + | + |
| + | − | + | − | + | − |
| + | + | + | + | + | + |
| + | − | + | − | + | − |
| + | + | + | + | + | + |
| + | − | + | − | + | − |

N+2 frame

| | | | | | |
|---|---|---|---|---|---|
| + | − | + | − | + | − |
| + | + | + | + | + | + |
| + | − | + | − | + | − |
| + | + | + | + | + | + |
| + | − | + | − | + | − |
| + | + | + | + | + | + |

N+3 frame

| | | | | | |
|---|---|---|---|---|---|
| − | + | − | + | − | + |
| + | + | + | + | + | + |
| − | + | − | + | − | + |
| + | + | + | + | + | + |
| − | + | − | + | − | + |
| + | + | + | + | + | + |

METHOD OF DRIVING DISPLAY PANEL AND DISPLAY APPARATUS FOR PERFORMING THE SAME

CROSS-REFERENCE TO RELATED APPLICATION

This application claims priority to and the benefit of Korean Patent Application No. 10-2014-0087339, filed on Jul. 11, 2014 in the Korean Intellectual Property Office KIPO, the content of which is herein incorporated by reference in its entirety.

BACKGROUND

1. Field

Aspects of example embodiments of the present inventive concept relate to a method of driving a display panel and a display apparatus for performing the method. More particularly, aspects of example embodiments of the present inventive concept relate to a method of driving a display panel for improving a display quality and a display apparatus for performing the method.

2. Description of the Related Art

Generally, a liquid crystal display ("LCD") apparatus includes a first substrate including a pixel electrode, a second substrate including a common electrode, and a liquid crystal layer disposed between the first and second substrates. An electric field is generated by voltages applied to the pixel electrode and the common electrode. By adjusting an intensity of the electric field, a transmittance of light passing through the liquid crystal layer may be adjusted, so that a desired image may be displayed.

A grayscale (e.g., grayscale level) of a pixel is determined by a difference between a pixel voltage applied to the pixel electrode and a common voltage applied to the common electrode. When the pixel electrode has a single polarity with respect to the common voltage, a residual DC voltage may be accumulated at the common electrode. Due to the accumulated residual DC voltage, a display quality of the display panel may be deteriorated.

To prevent or reduce the residual DC voltage from being accumulated, a positive pixel voltage having a positive polarity with respect to the common voltage and a negative pixel voltage having a negative polarity with respect to the common voltage may be alternately applied to the pixels of the display panel in every frame. However, since a direction of a kickback voltage is constant regardless of an inversion direction, a flickering effect may occur due to a difference between the positive pixel voltage and the negative pixel voltage with respect to the common voltage. Therefore, to prevent or reduce the flickering effect from occurring, an optimum common voltage may be selected, considering the kickback voltage.

In addition, when a liquid crystal display panel has a structure having an asymmetric shape between a pixel electrode and a common electrode, a shape of an electric field, which the positive pixel voltage is applied to the pixel electrode, has an asymmetric shape with respect to a shape of an electric field which the negative pixel voltage is applied to the pixel electrode. Thus, a DC bias may occur in one direction. Therefore, an afterimage may occur regardless of an inversion driving.

The above information disclosed in this Background section is only for enhancement of understanding of the background of the inventive concept, and therefore, it may contain information that does not form the prior art that is already known to a person of ordinary skill in the art.

SUMMARY

Aspects of example embodiments of the present inventive concept provide a method of driving a display panel capable of improving a display quality of the display panel.

Aspects of example embodiments of the present inventive concept also provide a display apparatus performing the method.

According to an example embodiment, a method of driving a display panel includes: generating a data signal having a difference between a number of positive frames and a number of negative frames; and displaying an image according to the data signal.

In an example embodiment, a DC bias may be formed in a direction from a pixel electrode of the display panel to a common electrode of the display panel, and the number of negative frames may be greater than the number of positive frames.

In an example embodiment, the data signal may be applied to a pixel of the display panel and may include a frame group. The frame group may include: N positive frames, where N is a natural number; and M negative frames, where M is a natural number greater than the N, and the frame group may be repeated in the data signal.

In an example embodiment, the N may be equal to 1 and the M may be equal to 3, and one positive frame and three negative frames may be arranged sequentially, and the arrangement, in which one positive frame and three negative frames may be arranged sequentially, may be repeated in the frame group.

In an example embodiment, the display panel may include a plurality pixel groups, each of the pixel groups may include four pixels forming two rows and two columns, and the four pixels may include: one pixel to which a positive pixel voltage may be applied; and three pixels to which a negative pixel voltage may be applied.

In an example embodiment, a DC bias may be formed in a direction from a common electrode of the display panel to a pixel electrode of the display panel, and the number of positive frame may be greater than the number of negative frames.

In an example embodiment, the data signal may be applied to a pixel of the display panel and may include a frame group, the frame group may include: M negative frames, where M may be a natural number; and N positive frames, where N may be a natural number greater than the M, and the frame group may be repeated in the data signal.

In an example embodiment, the M may be equal to one and the N may be equal to three, and one negative frame and three positive frames may be arranged sequentially, and the arrangement, in which one negative frame and three positive frames may be arranged sequentially, may be repeated in the frame group.

In an example embodiment, the display panel may include a plurality pixel groups, each of the pixel groups may include four pixels forming two rows and two columns, and the four pixels may include: one pixel to which a negative pixel voltage may be applied and three pixels to which a positive pixel voltage may be applied.

According to another example embodiment a display apparatus includes: a timing controller configured to generate a data signal having a difference between a number of positive frames and a number of negative frames; and a display panel configured to display an image according to the data signal.

In an example embodiment, a DC bias may be formed in a direction from a pixel electrode of the display panel to a common electrode of the display panel, and the number of negative frames may be greater than the number of positive frames.

In an example embodiment, the data signal may include a frame group, the frame group may include: N positive frames, where N may be a natural number; and M negative frames, where M may be a natural number greater than the N, and the frame group may be repeated in the data signal.

In an example embodiment, the N may be equal to one and the M may be equal to three, and one positive frame and three negative frames may be arranged sequentially, and the arrangement, in which one positive frame and three negative frames may be arranged sequentially, may be repeated in the frame group, and the display panel may include a plurality pixel groups, each of the pixels groups may include four pixels forming two rows and two columns, and the four pixels may include: one pixel to which a positive pixel voltage may be applied; and three pixels to which a negative pixel voltage may be applied.

In an example embodiment, a DC bias may be formed in a direction from a common electrode of the display panel to a pixel electrode of the display panel, and the number of positive frames may be greater than the number of negative frames.

In an example embodiment, the data signal may include a frame group, the frame group may include: M negative frames, where M may be a natural number; and N positive frames, where N may be a natural number greater than the M, and the frame group may be repeated in the data signal.

In an example embodiment, the M may be equal to one and the N may be equal to three and one negative frame and three positive frames may be arranged sequentially, and the arrangement, in which one negative frame and three positive frames are arranged sequentially, may be repeated in the frame group, and the display panel may include a plurality of pixel groups, each of the pixel groups may include four pixels forming two rows and two columns, and the four pixels may include: one pixel to which a negative pixel voltage may be applied and three pixels to which a positive pixel voltage may be applied.

According to example embodiments of the present inventive concept as described above, when the DC bias is generated between the pixel electrode and the common electrode, the number of positive frames and the number of negative frames may be adjusted to offset the DC bias. Therefore, an afterimage may be decreased and a display quality of the display panel may be improved.

BRIEF DESCRIPTION OF THE DRAWINGS

The above and other aspects and features of the present inventive concept will become more apparent from the following detailed description of the example embodiments with reference to the accompanying drawings, in which:

FIG. 8 is a conceptual diagram illustrating a pixel voltage applied to a pixel according to the waveform diagram shown in FIG. 7.

DETAILED DESCRIPTION

Figure 1:
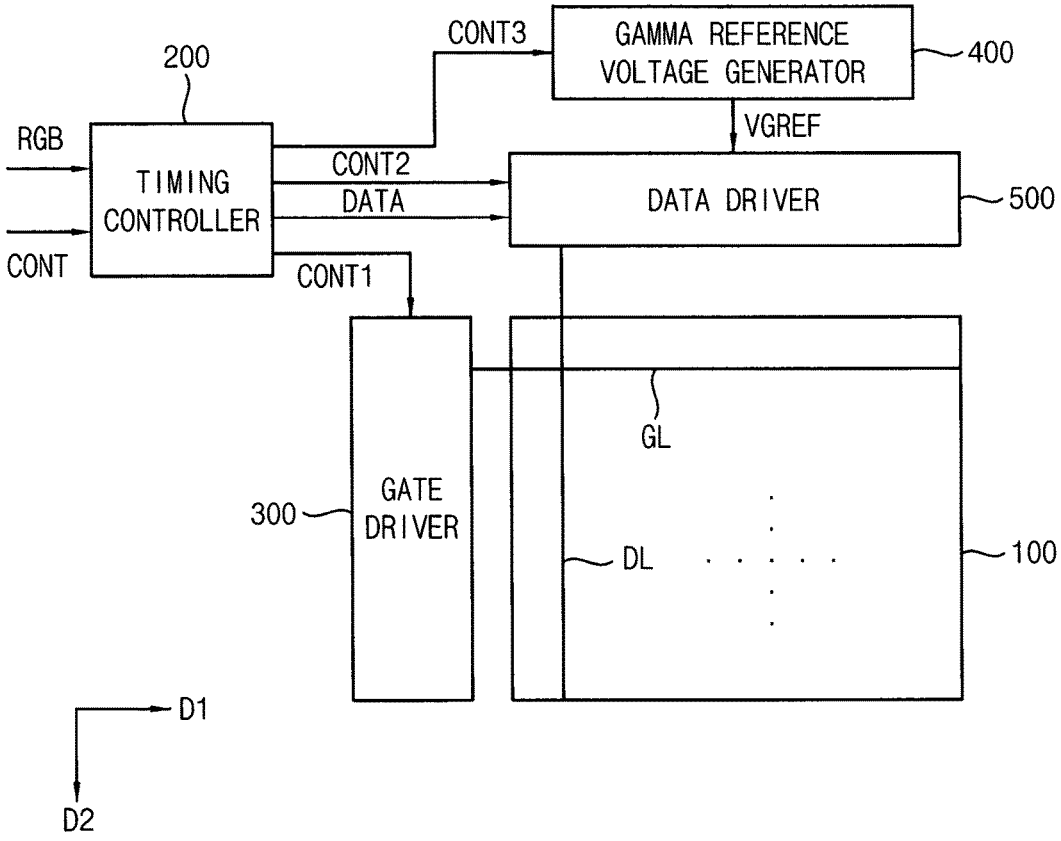
FIG. 1 is a block diagram illustrating a display apparatus according to an example embodiment of the present inventive concept.

Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey some of the aspects and features of the present invention to those skilled in the art. Accordingly, processes, elements, and techniques that are not necessary to those having ordinary skill in the art for a complete understanding of the aspects and features of the present invention are not described with respect to some of the embodiments of the present invention. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are only used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned over, elements described as "below" or "beneath" or "under" other elements or features would then be oriented "above" the other elements or features. Thus, the example terms "below" and "under" can encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it can be directly on, connected to, or coupled to the other element or layer, or one or more intervening elements or layers may be present. However, when an element or layer is referred to as being "directly on," "directly connected to," or "directly coupled to" another element or layer, there are no intervening elements or layers present. In addition, it will also be understood that when an element or layer is referred to as being "between" two elements or layers, it can be the only element or layer between the two elements or layers, or one or more intervening elements or layers may also be present.

The terminology used herein is for the purpose of describing particular embodiments only and is not intended to be limiting of the present invention. As used herein, the singular forms "a," "an," and "the" are intended to include the plural forms as well, unless the context clearly indicates otherwise. It will be further understood that the terms "comprises" and/or "comprising," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." Also, the term "exemplary" is intended to refer to an example or illustration.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

FIG. 1 is a block diagram illustrating a display apparatus according to an example embodiment of the present inventive concept.

Referring to FIG. 1, the display apparatus includes a display panel 100 and a panel driver. The panel driver includes a timing controller 200, a gate driver 300, a gamma reference voltage generator 400, and a data driver 500.

The display panel 100 has a display region on which an image is displayed and a peripheral region adjacent to the display region.

The display panel 100 includes a plurality of gate lines GL, a plurality of data lines DL, and a plurality of subpixels coupled (e.g., connected) to the gate lines GL and the data lines DL. The gate lines GL extend in a first direction D1 and the data lines DL extend in a second direction D2 crossing the first direction D1.

Each subpixel includes a switching element, a liquid crystal capacitor, and a storage capacitor. The liquid crystal capacitor and the storage capacitor are electrically coupled (e.g., electrically connected) to the switching element. The subpixels may be disposed in a matrix form. Some of the subpixels may form a pixel. For example, a red subpixel, a green subpixel, and a blue subpixel may form a pixel.

The timing controller 200 receives input image data RGB, and an input control signal CONT from an external apparatus. The input image data may include red image data R, green image data G, and blue image data B. The input control signal CONT may include a master clock signal and a data enable signal. The input control signal CONT may include a vertical synchronizing signal and a horizontal synchronizing signal.

The timing controller 200 generates a first control signal CONT1, a second control signal CONT2, a third control signal CONT3, and a data signal DATA, based on the input image data RGB and the input control signal CONT.

The timing controller 200 generates the first control signal CONT1 to control an operation of the gate driver 300 based on the input control signal CONT, and outputs the first control signal CONT1 to the gate driver 300. The first control signal CONT1 may further include a vertical start signal and a gate clock signal.

The timing controller 200 generates the second control signal CONT2 to control an operation of the data driver 500 based on the input control signal CONT, and outputs the second control signal CONT2 to the data driver 500. The second control signal CONT2 may include a horizontal start signal and a load signal. The second control signal CONT2 may further include an inversion control signal.

The timing controller 200 generates the data signal DATA based on the input image data RGB. The timing controller 200 outputs the data signal DATA to the data driver 500.

The timing controller 200 generates the third control signal CONT3 to control an operation of the gamma reference voltage generator 400 based on the input control signal CONT, and outputs the third control signal CONT3 to the gamma reference voltage generator 400.

A structure of the timing controller driver 200 is described below with reference to FIG. 2 in more detail.

The gate driver 300 generates gate signals to drive the gate lines GL, in response to the first control signal CONT1 received from the timing controller 200. The gate driver 300 sequentially outputs the gate signals to the gate lines GL.

The gate driver 300 may be directly mounted on the display panel 100, or may be coupled to the display panel 100 as, for example, a tape carrier package (TCP). Alternatively, the gate driver 300 may be integrated on the display panel 100.

The gamma reference voltage generator 400 generates a gamma reference voltage VGREF, in response to the third control signal CONT3 received from the timing controller 200. The gamma reference voltage generator 400 provides the gamma reference voltage VGREF to the data driver 500. The gamma reference voltage VGREF has a value corresponding to a level of the data signal DATA.

In an example embodiment, the gamma reference voltage generator 400 may be disposed in the timing controller 200, or in the data driver 500. However, the present inventive concept is not limited thereto.

The data driver 500 receives the second control signal CONT2 and the data signal DATA from the timing controller 200, and receives the gamma reference voltages VGREF from the gamma reference voltage generator 400. The data driver 500 converts the data signal DATA into data voltages (e.g., data voltages having an analog type) using the gamma reference voltages VGREF. The data driver 500 sequentially outputs the data voltages to the data lines DL.

The data driver 500 may be directly mounted on the display panel 100, or may be coupled to the display panel 100, for example, in a TCP. Alternatively, the data driver 500 may be integrated on the peripheral region of the display panel 100.

Figure 2:
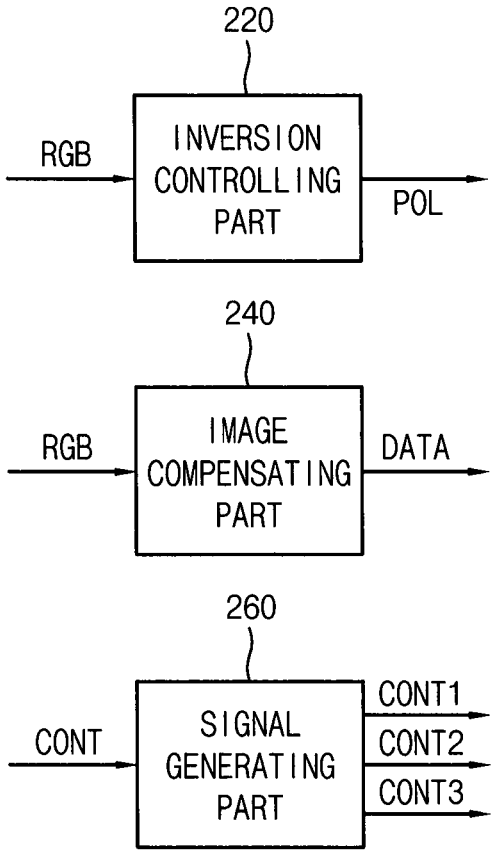
FIG. 2 is a block diagram illustrating a timing controller shown in FIG. 1.

FIG. 2 is a block diagram illustrating a timing controller shown in FIG. 1.

Figure 3A:
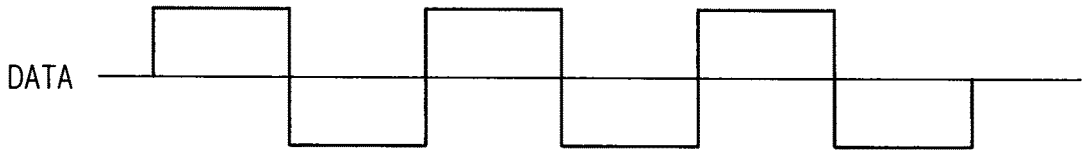
FIG. 3A is a waveform diagram illustrating a data signal according to an inversion driving method.

FIG. 3A is a waveform diagram illustrating a data signal according to an inversion driving method.

Figure 4:
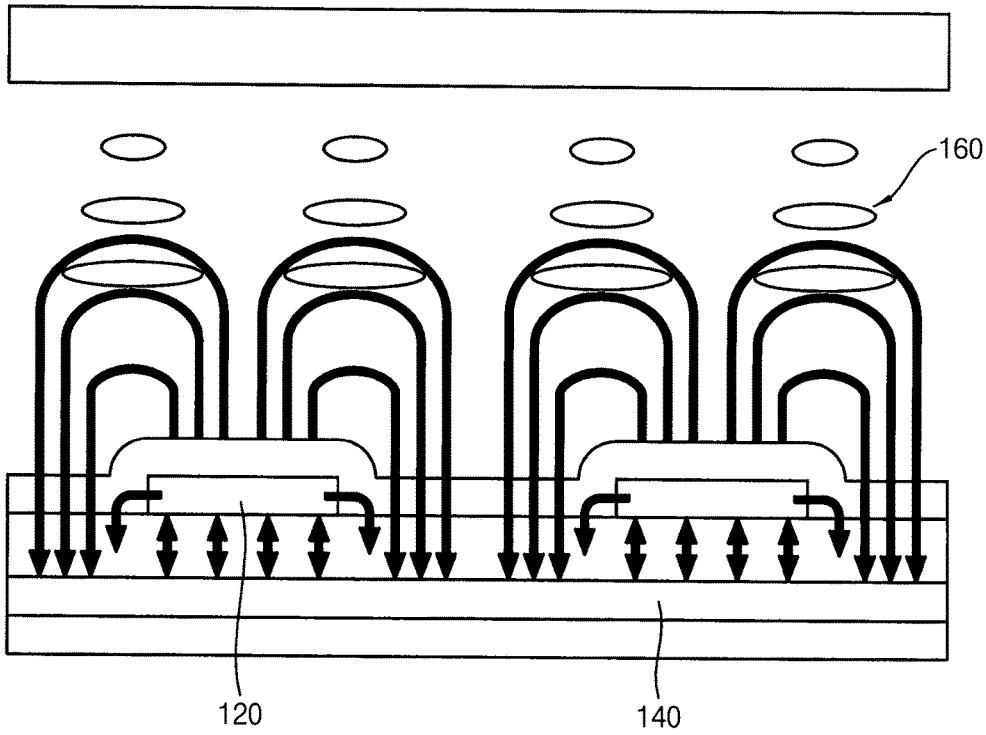
FIG. 4 is a plan view illustrating an electric field formed between electrodes of a display panel.

FIG. 4 is a plan view illustrating an electric field formed between electrodes of a display panel.

Referring to FIGS. 1, 2, 3A, and 4, the timing controller 200 includes an inversion controlling part 220 (e.g., an inversion controller), an image compensating part 240 (e.g., an image compensator), and a signal generating part 260 (e.g., a signal generator).

The inversion controlling part 220 receives the input image data RGB. The inversion controlling part 220 outputs an inversion control signal POL to the data driver 500. Alternatively, the inversion controlling part 220 may output the inversion control signal POL to the image compensating part 240. The inversion control signal POL may determine a polarity of each frame of the data signal DATA.

The image compensating part 240 compensates the input image data RGB to generate a data signal DATA. The image compensating part 240 may include an adaptive color correcting part (e.g., an adaptive color corrector) and a dynamic capacitance compensating part (e.g., a dynamic capacitance compensator).

The adaptive color correcting part receives the input image data RGB, and operates an adaptive color correction ("ACC"). The adaptive color correcting part may compensate the input image data RGB using a gamma curve.

The dynamic capacitance compensating part operates a dynamic capacitance compensation ("DCC"), which compensates the grayscale data (e.g., grayscale level or values) of present frame data using previous frame data and the present frame data.

The signal generating part 260 generates the first control signal CONT1 based on the input control signal CONT. The signal generating part 260 outputs the first control signal CONT1 to the gate driver 300. The signal generating part 260 generates the second control signal CONT2 based on the input control signal CONT. The signal generating part 260 outputs the second control signal CONT2 to the data driver 500. The signal generating part 260 generates the third control signal CONT3 based on the input control signal CONT. The signal generating part 260 outputs the third control signal CONT3 to the gamma reference voltage generator 400.

The timing controller 200 generates the data signal DATA based on the inversion control signal POL. The inversion control signal POL may determine a polarity of each frame of the data signal DATA. The data signal DATA may include a positive frame and a negative frame. The positive frame and the negative frame may alternate every frame. The timing controller 200 outputs the data signal DATA to the data driver 500.

The data driver 500 outputs a data voltage to the data line DL based on the data signal DATA. The data line DL may be electrically coupled to a pixel. The data voltage may be applied to a pixel electrode 120 of the pixel. A common voltage that may minimize or reduce flickering may be applied to a common electrode 140. An electric field may be formed between the pixel electrode 120 and the common electrode 140. A liquid crystal 160 may be aligned along the electric field, so that an image is displayed. The pixel electrode 120 and the common electrode 140 may be asymmetric to each other.

Figure 3B:
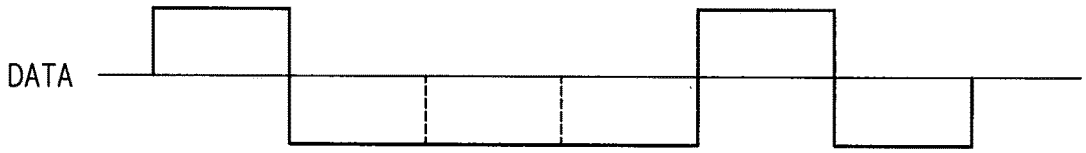
FIG. 3B is a waveform diagram illustrating a data signal according to an example embodiment of the present inventive concept.

FIG. 3B is a waveform diagram illustrating a data signal according to an example embodiment of the present inventive concept.

Referring to FIGS. 1, 2, 3B, and 4, the timing controller 200 includes an inversion controlling part 220 (e.g., an inversion controller), an image compensating part 240 (e.g., an image compensator), and a signal generating part 260 (e.g., a signal generator).

The inversion controlling part 220 receives the input image data RGB. The inversion controlling part 220 outputs an inversion control signal POL to the data driver 500. The inversion control signal POL may determine a polarity of each frame of the data signal DATA.

The image compensating part 240 compensates the input image data RGB to generate a data signal DATA. The image compensating part 240 may include an adaptive color correcting part (e.g., an adaptive color corrector) and a dynamic capacitance compensating part (e.g., a dynamic capacitance compensator).

The adaptive color correcting part receives the input image data RGB and operates an adaptive color correction ("ACC"). The adaptive color correcting part may compensate the input image data RGB using a gamma curve.

The dynamic capacitance compensating part operates a dynamic capacitance compensation ("DCC"), which compensates the grayscale data (e.g., grayscale level or values) of present frame data using previous frame data and the present frame data.

The signal generating part 260 generates the first control signal CONT1 based on the input control signal CONT. The signal generating part 260 outputs the first control signal CONT1 to the gate driver 300. The signal generating part 260 generates the second control signal CONT2 based on the input control signal CONT. The signal generating part 260 outputs the second control signal CONT2 to the data driver 500. The signal generating part 260 generates the third control signal CONT3 based on the input control signal CONT. The signal generating part 260 outputs the third control signal CONT3 to the gamma reference voltage generator 400.

The timing controller 200 generates the data signal DATA based on the inversion control signal POL. The inversion control signal POL may determine a polarity of each frame of the data signal DATA. The data signal DATA may include a positive frame and a negative frame. The number of positive frames and the number of negative frames may be different. The timing controller 200 outputs the data signal DATA to the data driver 500.

The data driver 500 outputs a data voltage to the data line DL based on the data signal DATA. The data line DL may be electrically coupled (e.g., electrically connected) to a pixel. The data voltage may be applied to a pixel electrode 120 of the pixel. A common voltage that may minimize or reduce flickering may be applied to a common electrode 140. An electric field may be formed between the pixel electrode 120 and the common electrode 140. A liquid crystal 160 may be aligned along the electric field, so that an image is displayed. The pixel electrode 120 and the common electrode 140 may be asymmetric to each other. Thus, an electric field formed between the pixel electrode 120 and the common electrode 140 may be asymmetric, so that a DC bias may be generated between the pixel electrode 120 and the common electrode 140.

According to the present example embodiment, when the DC bias is generated between the pixel electrode 120 and the common electrode 140, the number of positive frames and the number of negative frames may be adjusted to offset the DC bias.

In the present example embodiment, the inversion controlling part 220 is disposed in the timing controller 200. However, the present inventive concept is not limited thereto. For example, alternatively, the inversion controlling part 220 may be formed independently from the timing controller 200, or the inversion controlling part 220 may be disposed in the data driver 500.

Figure 5:
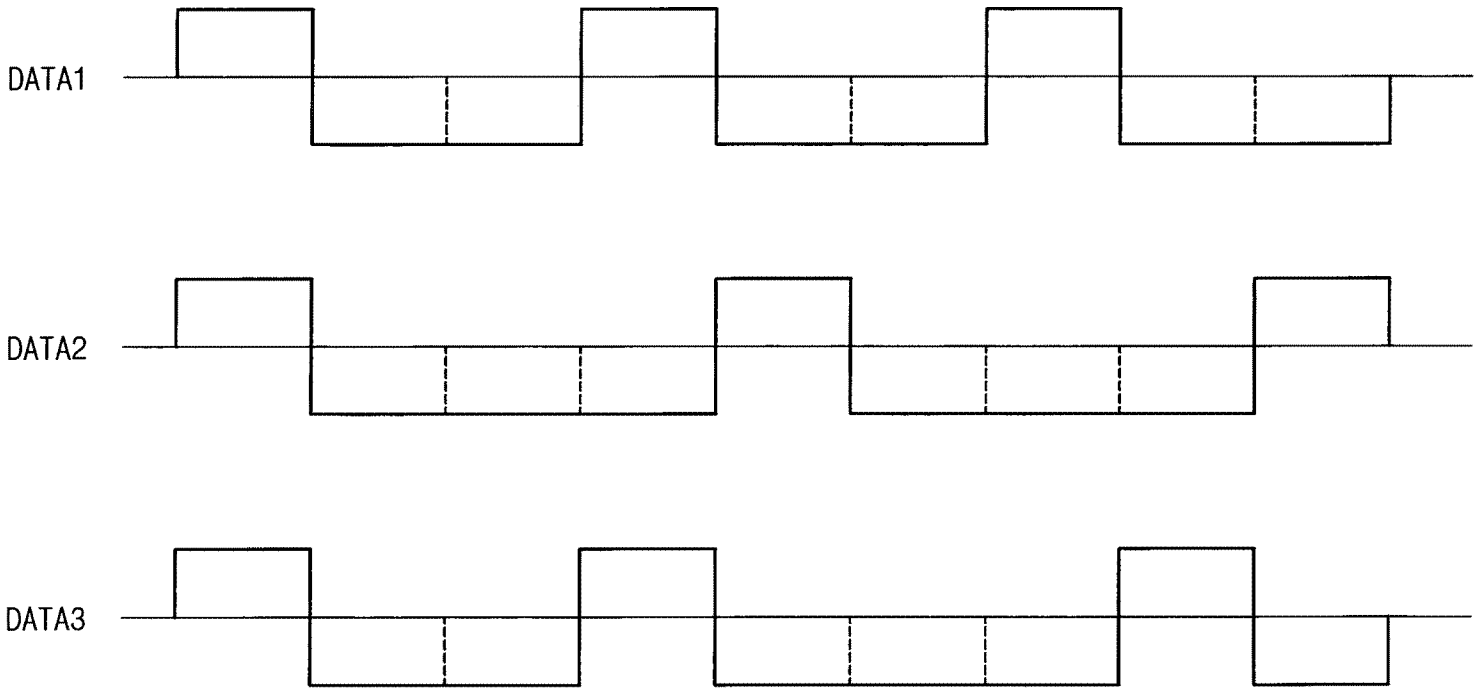
FIG. 5 is a waveform diagram illustrating data signals according to some example embodiments of the present inventive concept.

FIG. 5 is a waveform diagram illustrating data signals according to some example embodiments of the present inventive concept.

Referring to FIGS. 1, 2, 3B, 4, and 5, the timing controller 200 includes an inversion controlling part 220 (e.g., an inversion controller), an image compensating part 240 (e.g., an image compensator), and a signal generating part 260 (e.g., a signal generator).

The inversion controlling part 220 receives the input image data RGB. The inversion controlling part 220 outputs an inversion control signal POL to the data driver 500. The inversion control signal POL may determine a polarity of each frame of the data signal DATA.

The image compensating part 240 compensates the input image data RGB to generate a data signal DATA. The image compensating part 240 may include an adaptive color correcting part (e.g., an adaptive color corrector) and a dynamic capacitance compensating part (e.g., a dynamic capacitance compensator).

The adaptive color correcting part receives the input image data RGB and operates an adaptive color correction ("ACC"). The adaptive color correcting part may compensate the input image data RGB using a gamma curve.

The dynamic capacitance compensating part operates a dynamic capacitance compensation ("DCC"), which compensates the grayscale data of present frame data using previous frame data and the present frame data.

The signal generating part 260 generates the first control signal CONT1 based on the input control signal CONT. The signal generating part 260 outputs the first control signal CONT1 to the gate driver 300. The signal generating part 260 generates the second control signal CONT2 based on the input control signal CONT. The signal generating part 260 outputs the second control signal CONT2 to the data driver 500. The signal generating part 260 generates the third control signal CONT3 based on the input control signal CONT. The signal generating part 260 outputs the third control signal CONT3 to the gamma reference voltage generator 400.

The timing controller 200 generates the data signal DATA based on the inversion control signal POL. The inversion control signal POL may determine a polarity of each frame of the data signal DATA. The data signal DATA may include a positive frame and a negative frame. The number of positive frames and the number of negative frames may be different. For example, the number of negative frames may be greater than the number of positive frames.

For example, a first and a second data signal DATA1 and DATA2 may include a frame group, respectively. The frame group may include N ('N' is a natural number) positive frames and M ('M' is a natural number) negative frames, where the number of M negative frames is greater than the number of N positive frames. The frame group is repeated in the first and the second data signals DATA1 and DATA2. The positive frames and the negative frames may be aligned according to a same order in the first and the second data signals DATA1 and DATA2. The positive frames and the negative frames may be aligned randomly in a third data signal DATA3.

For example, the N may be equal to 1 and the M may be equal to 2. Alternatively, the N may be equal to 1 and the M may be equal to 3. Alternatively, the N may be equal to 2 and the M may be equal to 3. Alternatively, the N may be equal to 2 and the M may be equal to 5. Alternatively, the N may be equal to 2 and the M may be equal to.

In the present example embodiment, the N is equal to 1 and the M is equal to 2 for the first data DATA1, and the N is equal to 1 and the M is equal to 3 for the second data DATA2. However, the present inventive concept is not limited thereto. For example, the N and the M may have different values.

The timing controller 200 outputs the first and the second data signals DATA1 and DATA2 to the data driver 500.

The data driver 500 outputs a data voltage to the data line DL based on the first, the second, and the third data signals DATA1, DATA2, and DATA3. The data line DL may be electrically coupled to a pixel. The data voltage may be applied to a pixel electrode 120 of the pixel. A common voltage that may minimize or reduce flickering may be applied to a common electrode 140. An electric field may be formed between the pixel electrode 120 and the common electrode 140. A liquid crystal 160 may be aligned along the electric field, so that an image is displayed. The pixel electrode 120 and the common electrode 140 may be asymmetric to each other. Thus, an electric field formed between the pixel electrode 120 and the common electrode 140 may be asymmetric, so that a DC bias may be generated between the pixel electrode 120 and the common electrode 140. The DC bias may be formed in a direction from the pixel electrode 120 to the common electrode 140.

According to the present example embodiment, when the DC bias is generated between the pixel electrode 120 and the common electrode 140, the number of positive frames and the number of negative frames may be adjusted, for example, the number of negative frames may be greater than the number of positive frames. Therefore, the DC bias may be offset.

In the present example embodiment, the inversion controlling part 220 is disposed in the timing controller 200. However, the present inventive concept is not limited thereto. For example, the inversion controlling part 220 may be formed independently from the timing controller 200, or the inversion controlling part 220 may be disposed in the data driver 500.

Figure 6:
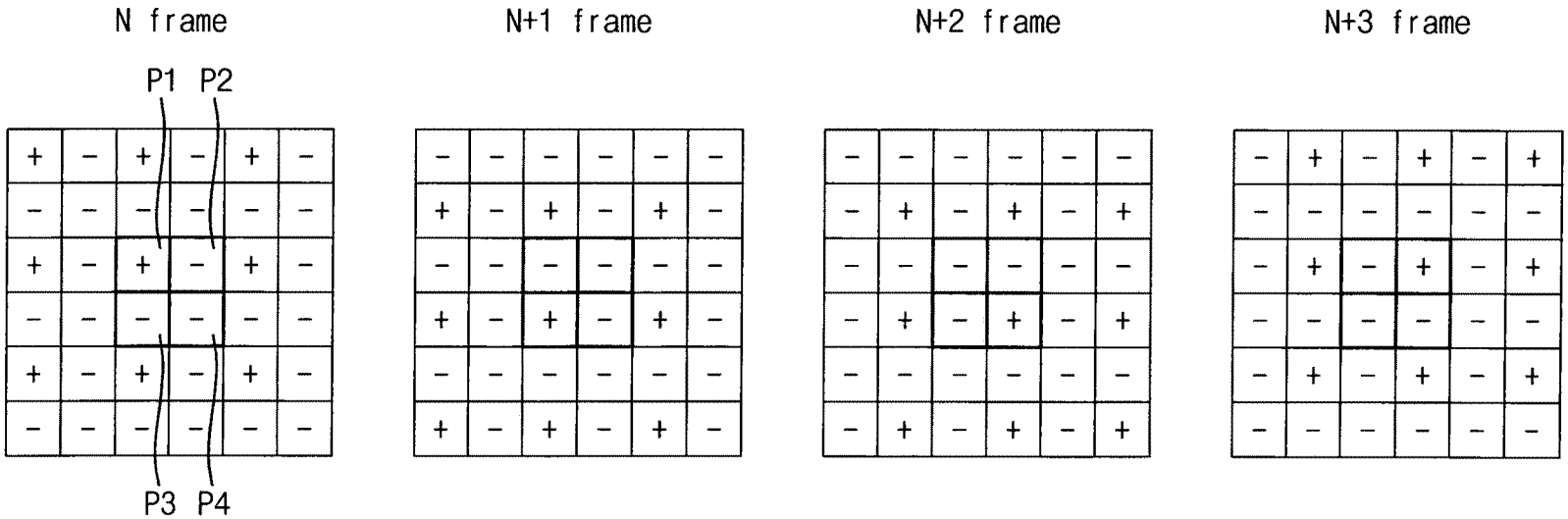
FIG. 6 is a conceptual diagram illustrating a pixel voltage applied to a pixel according to the waveform diagram shown in FIG. 5.

FIG. 6 is a conceptual diagram illustrating a pixel voltage applied to a pixel according to the waveform diagram shown in FIG. 5. That is, FIG. 6 illustrates a pixel voltage applied to a pixel when the second data signal DATA2 shown in FIG. 5 is output.

Referring to FIGS. 5 and 6, the number of positive frames and the number of negative frames may be different. The number of negative frames may be greater than the number of positive frames.

For example, a first data signal and a second data signal DATA1 and DATA2 may include a frame group respectively. The frame group may include N ('N' is a natural number) positive frames and M ('M' is a natural number) negative frames, where the number of M negative frames is greater than the number of N positive frames. The frame group is repeated in the first and the second data signals DATA1 and DATA2. The positive frames and the negative frames may be aligned according to a same order in the first and the second data signals DATA1 and DATA2. For example, the N may be equal to 1 and the M may be equal to 3.

For example, the second data signal DATA2 is repeated as an order, which a positive frame, a negative frame, a negative frame, and a negative frame are aligned sequentially.

For example, during an N-th frame, a positive pixel voltage may be applied to a first pixel P1 of the display panel 100. A negative pixel voltage may be applied to a second pixel P2 of the display panel 100. The negative pixel voltage may be applied to a third pixel P3 of the display panel 100. The negative pixel voltage may be applied to a fourth pixel P4 of the display panel 100.

During an N+1-th frame, the negative pixel voltage may be applied to the first pixel P1 of the display panel 100. The negative pixel voltage may be applied to the second pixel P2 of the display panel 100. The positive pixel voltage may be applied to the third pixel P3 of the display panel 100. The negative pixel voltage may be applied to the fourth pixel P4 of the display panel 100.

During an N+2-th frame, the negative pixel voltage may be applied to the first pixel P1 of the display panel 100. The negative pixel voltage may be applied to the second pixel P2 of the display panel 100. The negative pixel voltage may be applied to the third pixel P3 of the display panel 100. The positive pixel voltage may be applied to the fourth pixel P4 of the display panel 100.

During an N+3-th frame, the negative pixel voltage may be applied to the first pixel P1 of the display panel 100. The positive pixel voltage may be applied to the second pixel P2 of the display panel 100. The negative pixel voltage may be applied to the third pixel P3 of the display panel 100. The negative pixel voltage may be applied to the fourth pixel P4 of the display panel 100.

The display panel 100 may include a plurality pixel groups. The pixel group may include the first, the second, the third, and the fourth pixels P1, P2, P3 and P4, which are arranged (e.g., formed) in two rows and two columns. The positive pixel voltage may be applied to one of the first, the second, the third, and the fourth pixels P1, P2, P3, and P4. The negative pixel voltage may be applied to the others.

In the present example embodiment, the inversion control signal POL having four different values may be used.

According to the present example embodiment, the number of pixels to which the positive pixel voltage is applied, and the number of pixels to which the negative pixel voltage is applied, are constant during one frame. Therefore, the flickering effect may be prevented or reduced.

In the present example embodiment, the N is equal to 1 and the M is equal to 2 for the first data DATA1, and the N is equal 1 and the M is equal to 3 for the second data DATA2. However, the present inventive concept is not limited thereto. For example, the N and the M may have different values.

Figure 7:
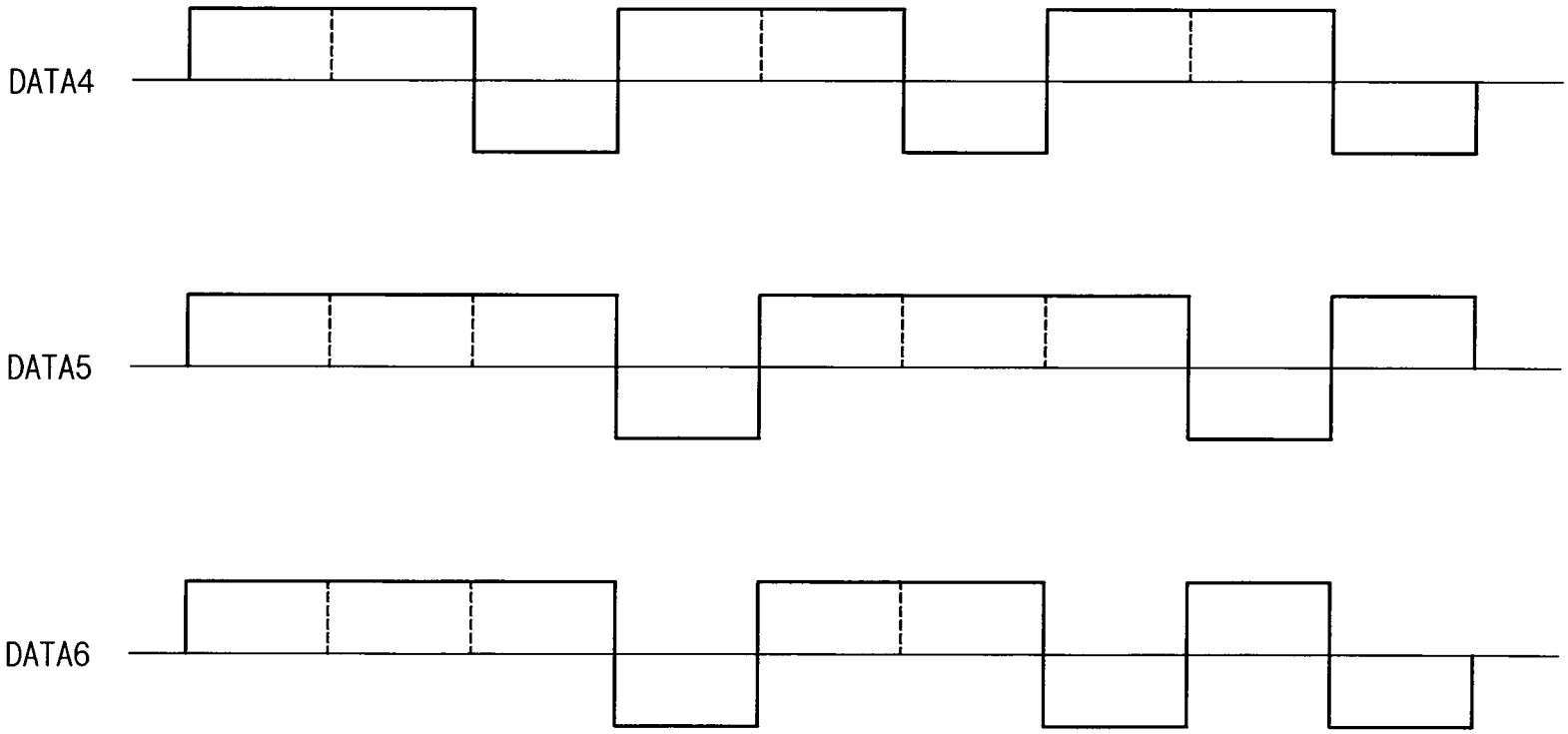
FIG. 7 is a waveform diagram illustrating data signals according to some example embodiments of the present inventive concept.

FIG. 7 is a waveform diagram illustrating data signals according to some example embodiments of the present inventive concept.

Referring to FIGS. 1, 2, 3B, 4, and 7, the timing controller 200 includes an inversion controlling part 220 (e.g., an inversion controller), an image compensating part 240 (e.g., an image compensator), and a signal generating part 260 (e.g., a signal generator).

The inversion controlling part 220 receives the input image data RGB. The inversion controlling part 220 outputs an inversion control signal POL to the data driver 500. The inversion control signal POL may determine a polarity of each frame of the data signal DATA.

The image compensating part 240 compensates the input image data RGB to generate a data signal DATA. The image compensating part 240 may include an adaptive color correcting part (e.g., an adaptive color corrector) and a dynamic capacitance compensating part (e.g., a dynamic capacitance compensator).

The adaptive color correcting part receives the input image data RGB and operates an adaptive color correction ("ACC"). The adaptive color correcting part may compensate the input image data RGB using a gamma curve.

The dynamic capacitance compensating part operates a dynamic capacitance compensation ("DCC"), which compensates the grayscale data of present frame data using previous frame data and the present frame data.

The signal generating part 260 generates the first control signal CONT1 based on the input control signal CONT. The signal generating part 260 outputs the first control signal CONT1 to the gate driver 300. The signal generating part 260 generates the second control signal CONT2 based on the input control signal CONT. The signal generating part 260 outputs the second control signal CONT2 to the data driver 500. The signal generating part 260 generates the third control signal CONT3 based on the input control signal CONT. The signal generating part 260 outputs the third control signal CONT3 to the gamma reference voltage generator 400.

The timing controller 200 generates the data signal DATA based on the inversion control signal POL. The inversion control signal POL may determine a polarity of each frame of the data signal DATA. The data signal DATA may include a positive frame and a negative frame. The number of positive frames and the number of negative frames may be different. For example, the number of positive frames may be greater than the number of negative frames.

For example, a fourth and a fifth data signal DATA4 and DATA5 may include a frame group, respectively. The frame group may include N ('N' is a natural number) positive frames and M ('M' is a natural number) negative frames, where the number of N positive frames is greater than the number of M negative frames. The frame group is repeated in the fourth and the fifth data signals DATA4 and DATA5. The positive frames and the negative frames may be aligned according to a same order in the fourth and the fifth data signals DATA4 and DATA5. The positive frames and the negative frames may be aligned randomly in a sixth data signal DATA6.

For example, the M may be equal to 1 and the N may be equal to 2. Alternatively, the M may be equal to 1 and the N may be equal to 3. Alternatively, the M may be equal to 2 and the N may be equal to 3. Alternatively, the M may be equal to 2 and the N may be equal to 5. Alternatively, the M may be equal to 2 and the N may be equal to 7.

In the present example embodiment, the M is equal to 1 and the N is equal to 2 for the fourth data signal DATA4, and the M is equal to 1 and the N is equal to 3 for the fifth data DATA5. However, the present inventive concept is not limited thereto. For example, the N and the M may have different values.

The timing controller 200 outputs the fourth and the fifth data signals DATA4 and DATA5 to the data driver 500.

The data driver 500 outputs a data voltage to the data line DL based on the fourth, the fifth, and the sixth data signals DATA4, DATA5, and DATA6. The data line DL may be electrically coupled to a pixel. The data voltage may be applied to a pixel electrode 120 of the pixel. A common voltage that may minimize or reduce flickering may be applied to a common electrode 140. An electric field may be formed between the pixel electrode 120 and the common electrode 140. A liquid crystal 160 may be aligned along the electric field, so that an image is displayed. The pixel electrode 120 and the common electrode 140 may be asymmetric to each other. Thus, an electric field formed between the pixel electrode 120 and the common electrode 140 may be asymmetric, so that a DC bias may be generated between the pixel electrode 120 and the common electrode 140. The DC bias may be formed in a direction from the common electrode 140 to the pixel electrode 120.

According to the present example embodiment, when the DC bias is generated between the pixel electrode 120 and the common electrode 140, the number of positive frames and the number of negative frames may be adjusted, for example, the number of positive frames may be greater than the number of negative frames. Therefore, the DC bias may be offset.

In the present example embodiment, the inversion controlling part 220 is disposed in the timing controller 200. However, the present inventive concept is not limited thereto. For example, the inversion controlling part 220 may be formed independently from the timing controller 200, or the inversion controlling part 220 may be disposed in the data driver 500.

FIG. 8 is a conceptual diagram illustrating a pixel voltage applied to a pixel according to the waveform diagram shown in FIG. 7. That is, FIG. 8 illustrates a pixel voltage applied to a pixel when the fifth data signal DATA5 shown in FIG. 7 is output.

Referring to FIGS. 7 and 8, the number of positive frames and the number of negative frames may be different. For example, the number of positive frames may be greater than the number of negative frames.

For example, the fourth and the fifth data signals DATA4 and DATA5 may include a frame group, respectively. The frame group may include N ('N' is a natural number) positive frames and M ('M' is a natural number) negative frames, where the number of N positive frames is greater than the number of M negative frames. The frame group is repeated in the fourth and the fifth data signals DATA4 and DATA5. The positive frames and the negative frames may be aligned according to a same order in the fourth and the fifth data signals DATA4 and DATA5. For example, the M may be equal to 1 and the N may be equal to 3.

For example, the fifth data signal DATA5 is repeated as an order which includes a positive frame, a positive frame, a positive frame, and a negative frame that are aligned sequentially.

For example, during an N-th frame, a negative pixel voltage may be applied to a fifth pixel P5 of the display panel 100. A positive pixel voltage may be applied to a sixth pixel P6 of the display panel 100. The positive pixel voltage may be applied to a seventh pixel P7 of the display panel 100. The positive pixel voltage may be applied to a eighth pixel P8 of the display panel 100.

During an N+1-th frame, a positive pixel voltage may be applied to the fifth pixel P5 of the display panel 100. The positive pixel voltage may be applied to the sixth pixel P6 of the display panel 100. A negative pixel voltage may be applied to the seventh pixel P7 of the display panel 100. The positive pixel voltage may be applied to the eighth pixel P8 of the display panel 100.

During an N+2-th frame, a positive pixel voltage may be applied to the fifth pixel P5 of the display panel 100. The positive pixel voltage may be applied to the sixth pixel P6 of the display panel 100. The positive pixel voltage may be applied to the seventh pixel P7 of the display panel 100. A negative pixel voltage may be applied to the eighth pixel P8 of the display panel 100.

During an N+3-th frame, a positive pixel voltage may be applied to the fifth pixel P5 of the display panel 100. A negative pixel voltage may be applied to the sixth pixel P6 of the display panel 100. The positive pixel voltage may be applied to the seventh pixel P7 of the display panel 100. The positive pixel voltage may be applied to the eighth pixel P8 of the display panel 100.

The display panel 100 may include a plurality of pixel groups. The pixel groups may include the fifth, the sixth, the seventh, and the eighth pixels P5, P6, P7, and P8 forming two rows and two columns. The negative pixel voltage may be applied to one of the fifth, the sixth, the seventh, and the eighth pixels P5, P6, P7 and P8. The positive pixel voltage may be applied to the others.

In present example embodiment, the inversion control signal POL having four different values may be used.

According to the present example embodiment, the number of pixels to which the positive pixel voltage is applied, and the number of pixels to which the negative pixel voltage is applied, are constant during one frame. Therefore, the flickering effect may be prevented or reduced.

In the present example embodiment, the M is equal to 1 and the N is equal to 2 for the fourth data DATA4, and the M is equal to 1 and the N is equal to 3 for the fifth data DATA5. However, the present inventive concept is not limited thereto. For example, the N and the M may have different values.

The foregoing is illustrative of the present invention and is not to be construed as limiting thereof. Although a few example embodiments of the present invention have been described, those skilled in the art will readily appreciate that various modifications are possible in the example embodiments without departing from the spirit and scope of the present invention. Accordingly, all such modifications are intended to be included within the spirit and scope of the present invention as defined in the claims, and their equivalents. In the claims, means-plus-function clauses, if any, are intended to cover the structures described herein as performing the recited function, and not only structural equivalents but also equivalent structures. Therefore, it is to be understood that the foregoing is illustrative of the present invention and is not to be construed as limited to the specific example embodiments disclosed herein, and that modifications to the disclosed example embodiments, as well as other example embodiments, are intended to be included within the spirit and scope of the appended claims and their equivalents. The present inventive concept is defined by the following claims, with equivalents of the claims to be included therein.

What is claimed is:

1. A method of driving a display panel, the method comprising:

generating a data signal comprising a frame group having a difference between a number of positive frames and a number of negative frames, the frame group being repeated in the data signal; and displaying an image according to the data signal, wherein the difference between the number of positive frames and the number of negative frames offsets a DC bias formed between a pixel electrode of the display panel and a common electrode of the display panel, wherein the DC bias is formed in a direction from the common electrode of the display panel to the pixel electrode of the display panel, and the number of positive frames is greater than the number of negative frames.

2. The method of claim 1, wherein the data signal is applied to a pixel of the display panel and the frame group comprises:

M negative frames, where M is a natural number; and

N positive frames, where N is a natural number greater than the M, and the frame group is repeated in the data signal.

3. The method of claim 2, wherein the M is equal to one and the N is equal to three, and one negative frame and three positive frames are arranged sequentially, and the arrangement, in which one negative frame and three positive frames are arranged sequentially, is repeated in the frame group.

4. The method of claim 3, wherein the display panel comprises a plurality pixel groups, each of the pixel groups comprises four pixels forming two rows and two columns, and the four pixels comprise:

one pixel to which a negative pixel voltage is applied; and three pixels to which a positive pixel voltage is applied.

5. A method of driving a display panel, the method comprising:

generating a data signal comprising a frame group having a difference between a number of positive frames and a number of negative frames, the frame group being repeated in the data signal; and displaying an image according to the data signal, wherein the difference between the number of positive frames and the number of negative frames offsets a DC bias formed between a pixel electrode of the display panel and a common electrode of the display panel, wherein the DC bias is formed in a direction from the pixel electrode of the display panel to the common electrode of the display panel, and the number of negative frames is greater than the number of positive frames, wherein the data signal is applied to a pixel of the display panel, and the frame group comprises:

N positive frames, where N is a natural number; and

M negative frames, where M is a natural number greater than the N, and the frame group is repeated in the data signal, wherein the N is equal to one and the M is equal to three, and one positive frame and three negative frames are arranged sequentially, and the arrangement, in which one positive frame and three negative frames are arranged sequentially, is repeated in the frame group, and wherein the display panel comprises a plurality pixel groups, each of the pixel groups comprises four pixels forming two rows and two columns, and the four pixels comprise:

one pixel to which a positive pixel voltage is applied; and three pixels to which a negative pixel voltage is applied.

6. A display apparatus comprising:

a timing controller configured to generate a data signal comprising a frame group having a difference between a number of positive frames and a number of negative frames, the frame group being repeated in the data signal; and a display panel configured to display an image according to the data signal, wherein the difference between the number of positive frames and the number of negative frames offsets a DC bias formed between a pixel electrode of the display panel and a common electrode of the display panel, wherein the DC bias is formed in a direction from the common electrode of the display panel to the pixel electrode of the display panel, and the number of positive frames is greater than the number of negative frames.

7. The display apparatus of claim 6, wherein the frame group comprises:

M negative frames, where M is a natural number; and

N positive frames, where N is a natural number greater than the M, and the frame group is repeated in the data signal.

8. The display apparatus of claim 7, wherein the M is equal to 1 and the N is equal to 3, and one negative frame and three positive frames are arranged sequentially, and the arrangement, in which one negative frame and three positive frames are arranged sequentially, is repeated in the frame group, and wherein the display panel comprises a plurality of pixel groups, each of the pixel groups comprises four pixels forming two rows and two columns, and the four pixels comprise:

one pixel to which a negative pixel voltage is applied; and three pixels to which a positive pixel voltage is applied.

* * * * *